US009352361B2

(12) United States Patent
Cirio

(10) Patent No.: US 9,352,361 B2
(45) Date of Patent: May 31, 2016

(54) ELEVATOR FOR CAPS

(71) Applicant: AROL S.p.A., Canelli (Asti) (IT)

(72) Inventor: Sergio Cirio, Canelli (IT)

(73) Assignee: AROL S.p.A., Canelli (Asti) (IT)

( * ) Notice: Subject to any disclaimer, the term of this patent is extended or adjusted under 35 U.S.C. 154(b) by 0 days.

(21) Appl. No.: 14/664,400

(22) Filed: Mar. 20, 2015

(65) Prior Publication Data

US 2015/0314333 A1 Nov. 5, 2015

(30) Foreign Application Priority Data

May 5, 2014 (IT) ..... TO2014A0358

(51) Int. Cl.
*B07C 5/00* (2006.01)
*B07C 5/342* (2006.01)

(52) U.S. Cl.
CPC ..... *B07C 5/3422* (2013.01)

(58) Field of Classification Search
CPC ..... B07C 5/34; B07C 5/342
USPC ..... 209/577, 587, 938
See application file for complete search history.

(56) References Cited

U.S. PATENT DOCUMENTS 4,776,466 A * 10/1988 Yoshida ..... B07C 5/3408 209/565
5,335,790 A * 8/1994 Geiger ..... B07C 5/14 144/340
5,409,119 A * 4/1995 Rao Datari ..... B07C 5/10 209/580
5,659,624 A * 8/1997 Fazzari ..... G06K 9/6253 209/580
6,410,872 B2 * 6/2002 Campbell ..... B07C 5/342 209/576
8,337,283 B2 * 12/2012 Kormann ..... A01D 41/127 460/7
2008/0000816 A1 * 1/2008 Kenneway ..... B07C 5/02 209/577
2008/0314716 A1 * 12/2008 Lorange ..... B65G 1/03 198/383
2009/0107896 A1 4/2009 Gochar, Jr.
2015/0231814 A1 * 8/2015 Seger ..... B29C 49/4205 198/524

FOREIGN PATENT DOCUMENTS

DE 19852369 C1 3/2000
EP 2186758 A1 5/2010
FR 2961797 A1 12/2011

OTHER PUBLICATIONS

Italian Search Report and Written Opinion dated May 5, 2014 for Application No. TO2014A000358.

* cited by examiner

*Primary Examiner* — Terrell Matthews
(74) *Attorney, Agent, or Firm* — Patterson & Sheridan, L.L.P.

(57) ABSTRACT

Elevator for caps, comprising a closed-loop conveyor belt including a plurality of projections extending from an outer face of the conveyor belt, and an inspection and selection system, comprising: at least one camera arranged to visually inspect the caps while they move along an ascending branch of the conveyor belt, and an ejection device which ejects noncompliant caps from the elevator according to information provided by said at least one camera.

3 Claims, 6 Drawing Sheets

ELEVATOR FOR CAPS

CROSS-REFERENCE TO RELATED APPLICATIONS

This application claims benefit of Italian patent application number TO2014A000358, filed May 5, 2014, which is herein incorporated by reference.

BACKGROUND OF THE INVENTION

1. Field of the Invention

The present invention relates to an elevator for caps intended to be fed to a machine for closing containers.

2. Description of Prior Art

Machines for closing containers are fed with a continuous flow of caps with a predetermined orientation. Usually, apparatuses located upstream of the container-closing machines are used for orientating the caps.

Inspection systems are known, which include a vision system suitable for carrying out a visual inspection of the flow of moving caps. The vision systems allow the identification of numerous defects of the caps, such as deformation or ovalization of the caps and/or the relative safety ring, the presence of dirt, the absence of projections, etc. Discarding of the noncompliant caps avoids problems during closing of the containers, such as halting the production line, breaking of the capping heads, etc.

SUMMARY OF THE INVENTION

The present invention aims to provide an elevator for caps equipped with an integrated vision system which can overcome the problems of the prior art.

According to the present invention, this object is achieved by an elevator for caps, comprising a closed-loop conveyor belt including a plurality of projections extending from an outer face of the conveyor belt, and an inspection and selection system, comprising:

- at least one camera arranged to visually inspect the caps while they move along an ascending branch of the conveyor belt; and
- an ejection device which ejects noncompliant caps from the elevator according to information provided by said at least one camera.

BRIEF DESCRIPTION OF THE DRAWINGS

The present invention will now be described in detail with reference to the attached drawings, given purely by way of non-limiting example, in which.

DETAILED DESCRIPTION

Figure 1:
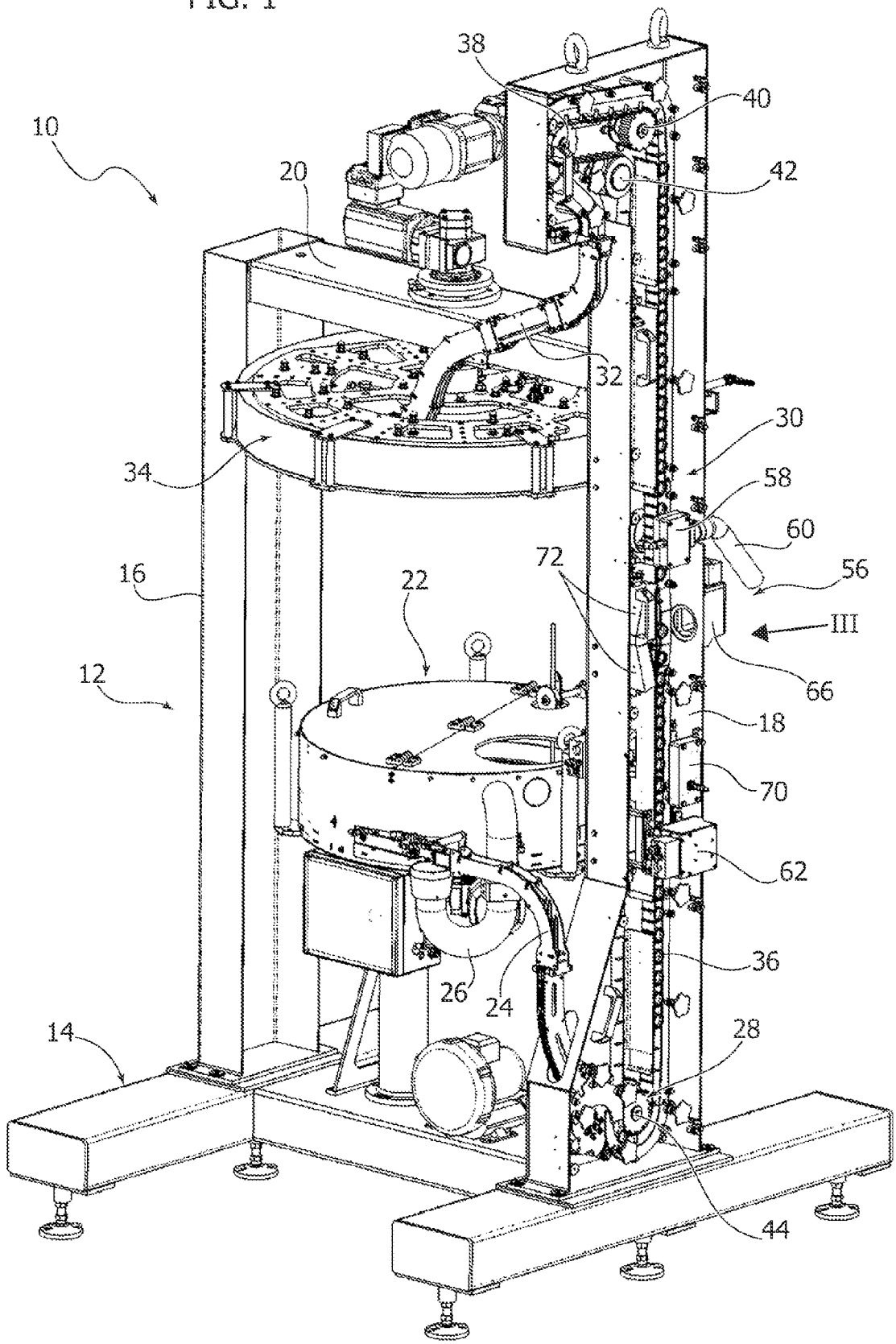
FIG. 1 is a perspective view illustrating a sorting apparatus for caps equipped with an elevator according to the present invention.
Figure 2:
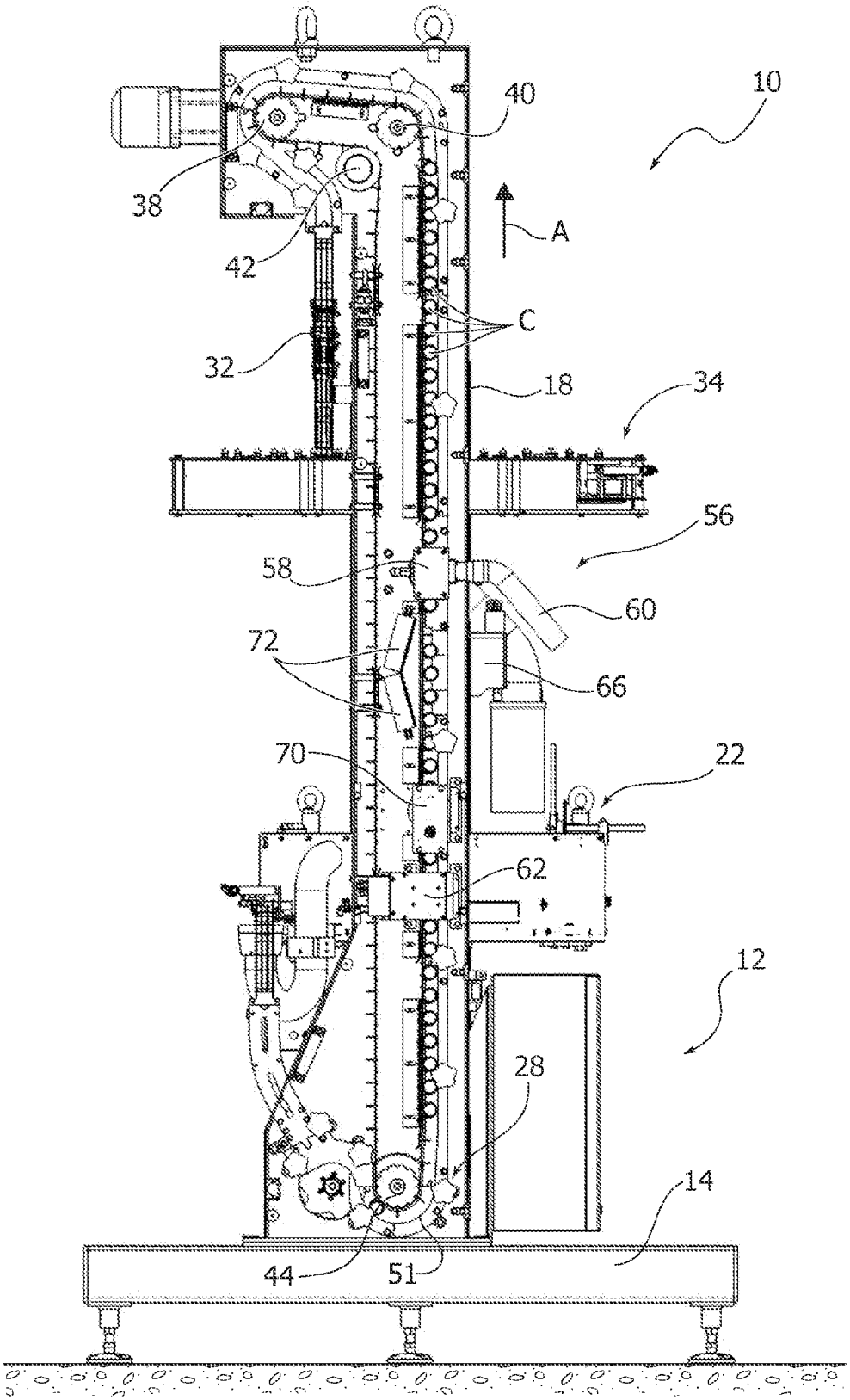
FIG. 2 is a side view of the sorting apparatus of FIG. 1.

With reference to FIGS. 1 and 2, numeral 10 indicates an apparatus for orientating caps intended to be fed to a machine for closing containers. The apparatus 10 comprises a stationary support structure 12 including a lower base 14, a pair of vertical uprights 16, 18 and an upper support 20.

The support structure 12 carries an orientation device 22, for example formed by a centrifugal orienter. The orientation device 22 has a cylindrical chamber in which the caps are contained in bulk. Within the cylindrical chamber a rotatable disc is arranged, which conveys the caps by centrifugal force towards an outlet channel 24. In the outlet channel 24, the caps are selected according to their position. The caps with a position that is different from the predetermined position fall into a collecting duct 26 that takes them back to the orientation device 22. The caps oriented in the predetermined manner advance along the outlet channel 24 and are sent to a loading device 28.

The orientating apparatus 10 comprises an elevator 30 carried by the uprights 18. The elevator 30 receives the caps from the loading device 28 at its lower end and transports them upwards in an upward-moving vertical row. At the upper end of the elevator 30, the caps are discharged into a channel 32. From the channel 32, the caps can be fed to a buffer 34 of known type per se, which in turn feeds the caps to a container-closing machine. Alternatively, the caps may be fed directly to the container-closing machine from the outlet of the elevator 30.

The elevator 30 comprises a closed-loop conveyor belt 36 on a transport path including a vertical branch. The conveyor belt 36 cooperates with a motor-driven pulley 38 and with a plurality of drive pulleys 40, 42, 44.

Figure 3:
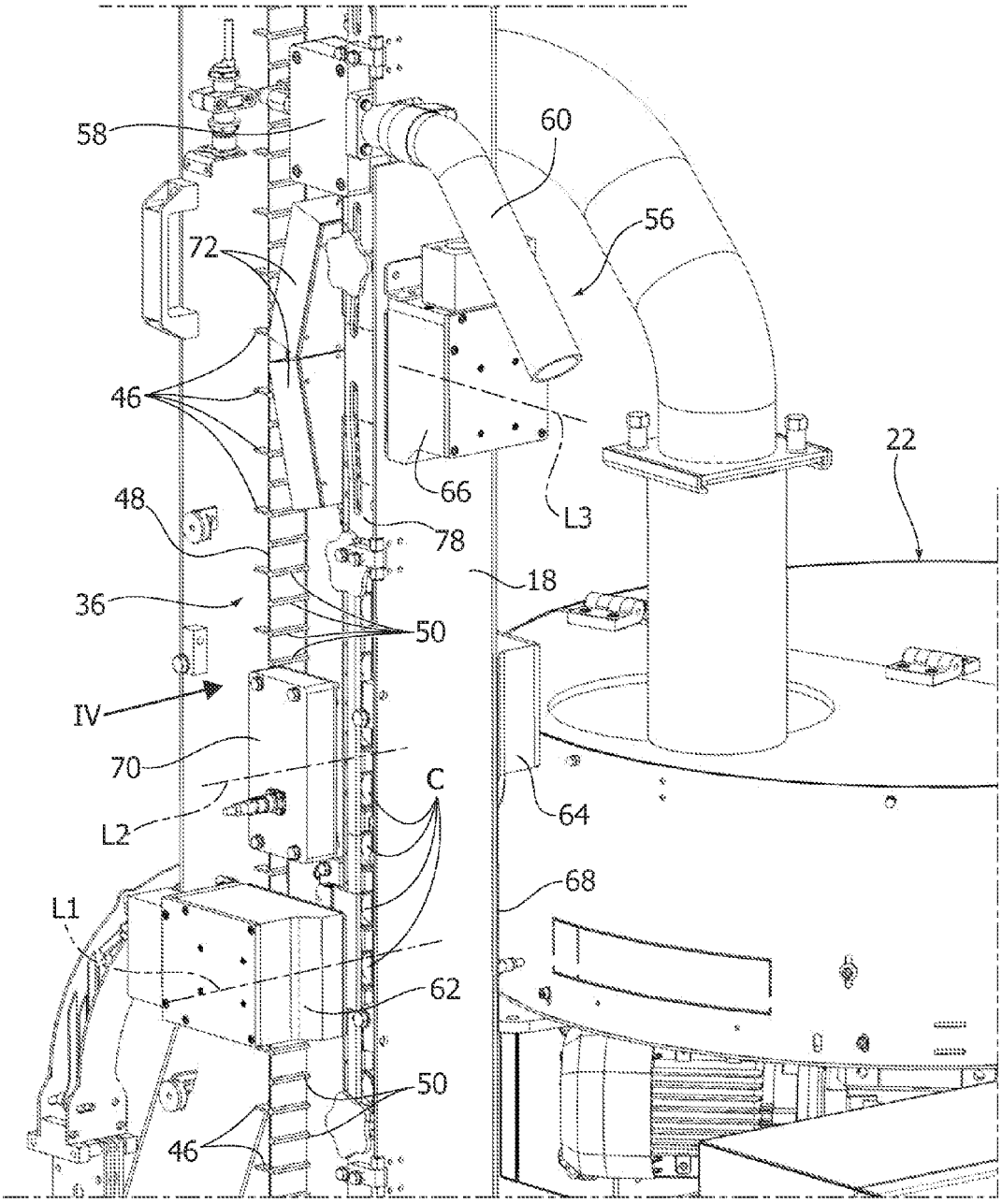
FIG. 3 is a perspective view on an enlarged scale of the part indicated by the arrow III in FIG. 1.
Figure 4:
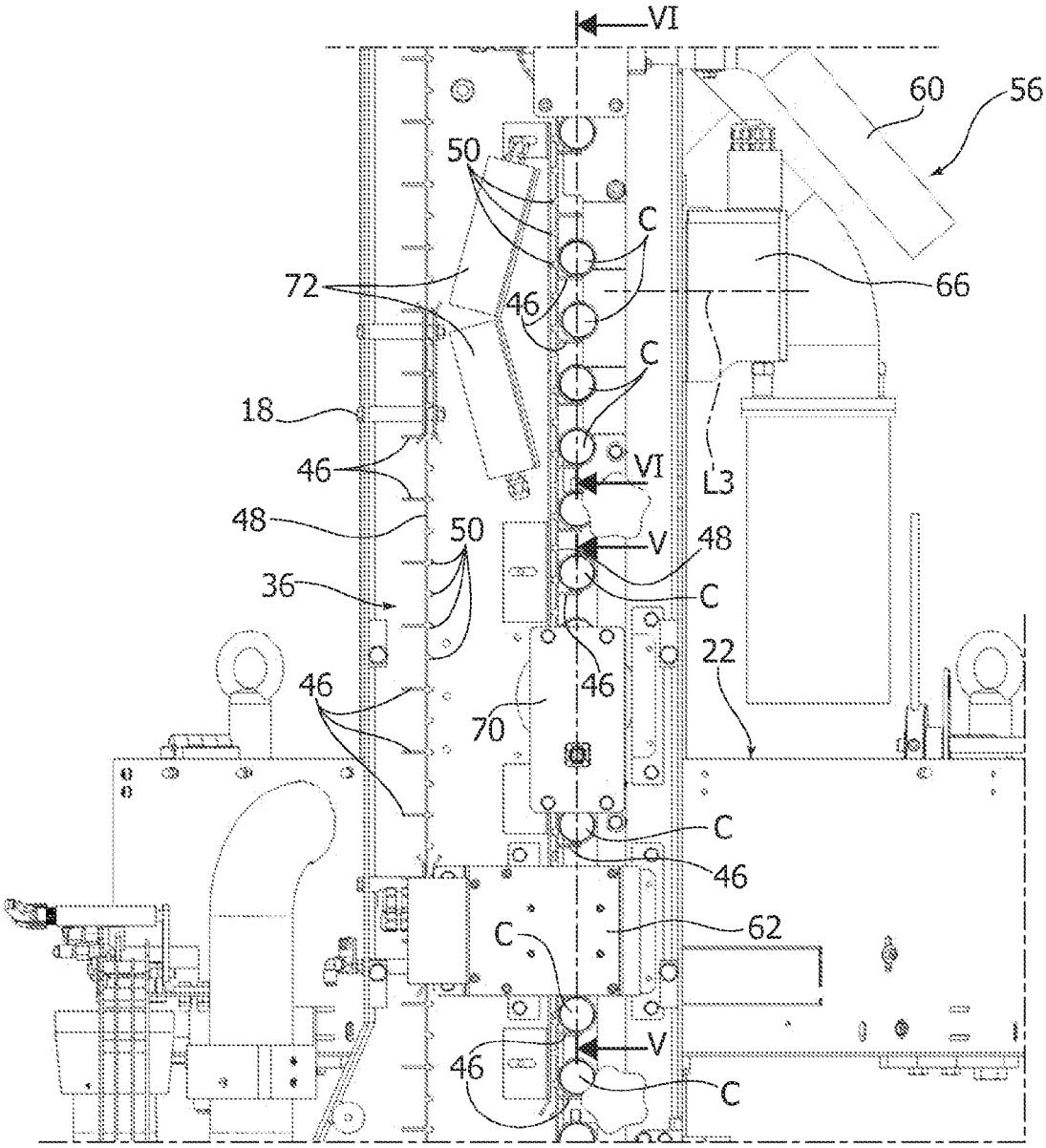
FIG. 4 is an elevation view of the part indicated by the arrow IV in FIG. 3.

As is visible in particular in FIGS. 3 and 4, the conveyor belt 36 comprises a plurality of projections 46 that protrude in a direction orthogonal to an outer face 48 of the conveyor belt 36. The projections 46 are spaced apart by a constant pitch in the longitudinal direction of the belt 36. A seat is defined between each pair of adjacent projections 46, configured to receive a single cap C. The conveyor belt 36 can be provided with a toothing 50 on its inner face, which cooperates with a corresponding toothing of the motor-driven pulley 38 and possibly with corresponding toothings of the drive pulleys 40, 44.

Along the ascending branch of the elevator 30, the outer face 48 of the conveyor belt 36 is contained in an essentially vertical plane, and the projections 46 have respective upper surfaces that are essentially horizontal.

With reference to FIG. 2, the loading device 28 is configured to load the caps C onto the conveyor belt 36, so that each projection 46 receives a single cap C. The loading device 28 comprises a semi-circular guide 51 located on the outside of the lower drive pulley 44 of the conveyor belt 36. The individual caps C are picked up from the projections 46. On the conveyor belt 36, the caps C are arranged so that the longitudinal axis of each cap C is horizontal and parallel to the outer face 48 of the conveyor belt 36. Each cap C has a cylindrical outer wall which rests on the respective projection 46.

Figure 5:
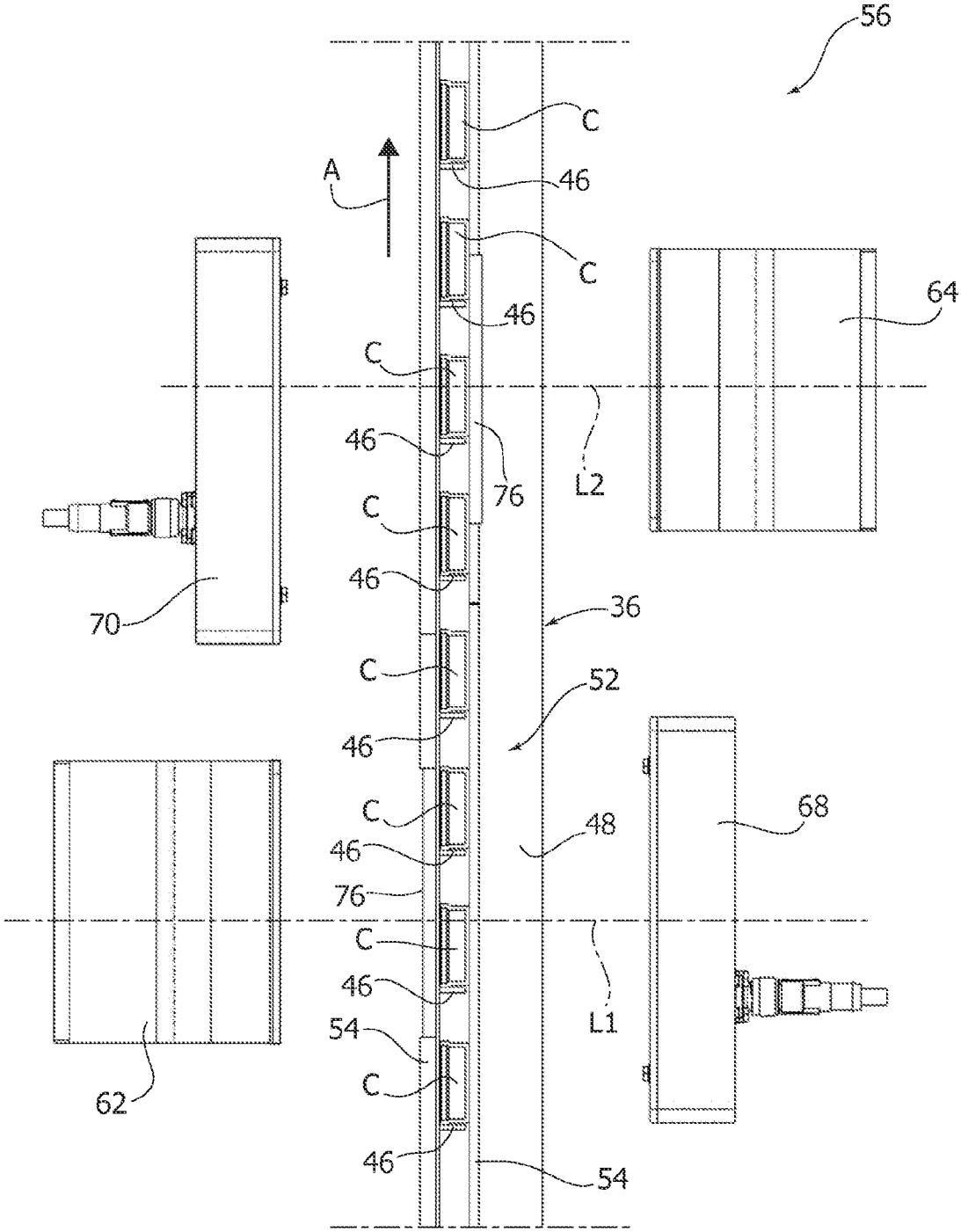
FIGS. 5 and 6 are cross-sections according to the lines V-V and VI-VI of FIG. 4, respectively.
Figure 6:
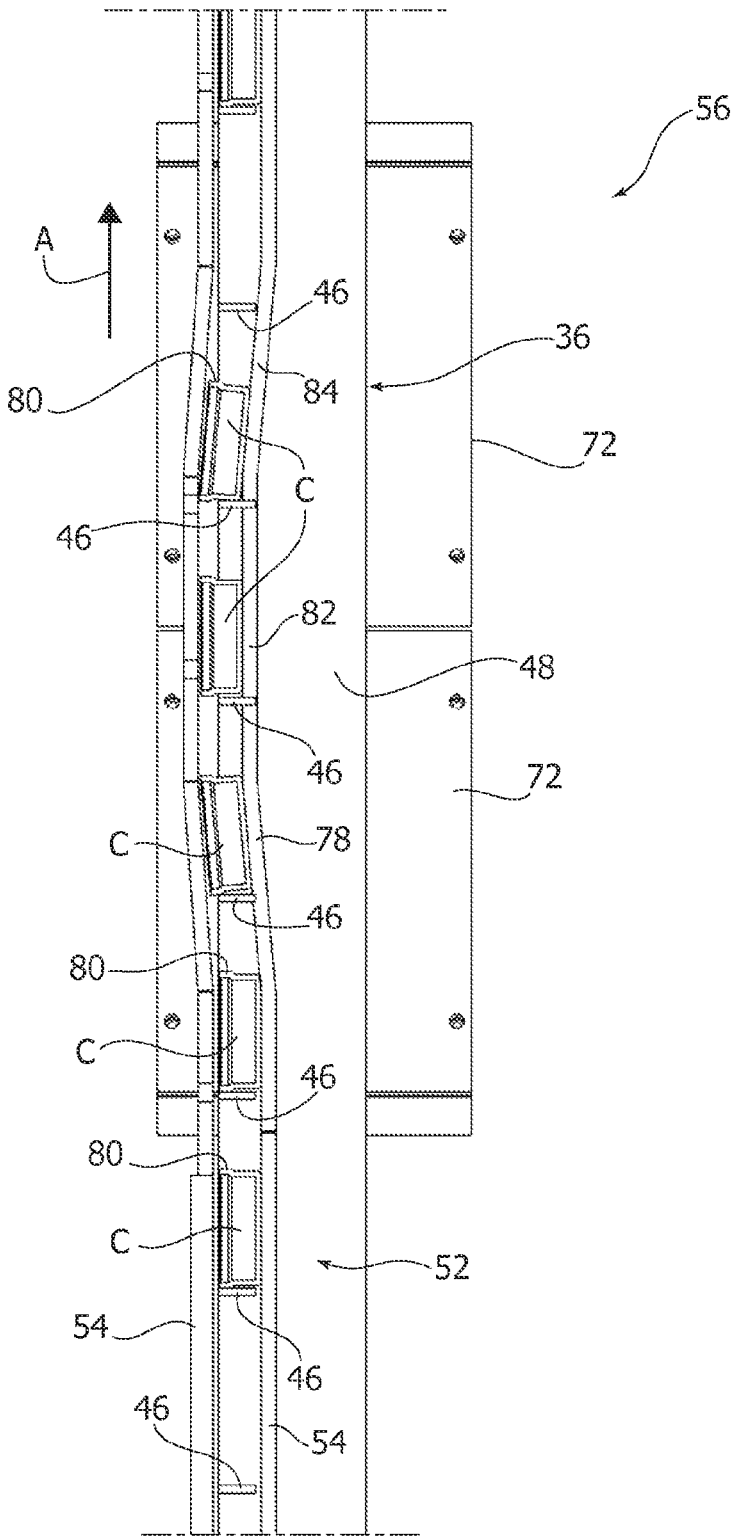

With reference to FIGS. 5 and 6, on the ascending branch of the elevator 30, the caps C move within a stationary guide channel 52 comprising two parallel walls 54 orthogonal to the outer face 48 of the conveyor belt 36. The conveyor belt 36 is located on the outside of the guide channel 52 but the projections 46 extend at least in part between the walls 54 for transporting the caps C in the direction indicated by the arrow A.

The elevator 30 comprises an inspection and selection device 56. The inspection and selection device 56 comprises at least one camera arranged to visually inspect the caps C while they move along the ascending branch of the elevator 30. The inspection and selection device 56 comprises an ejection device 58 (FIGS. 1 and 2) which ejects the noncompliant caps from the ascending branch of the elevator 30 according to the information provided by said at least one camera. The ejected caps are sent into a channel 60 and collected in a container (not shown).

With reference to FIGS. 3, 4 and 5, in the illustrated embodiment, the inspection and selection system 56 comprises a first camera 62, a second camera 64 and a third camera 66 having respective optical axes L1, L2, L3. The cameras 62, 64, 66 are associated with respective illuminators 68, 70, 72. The cameras 62, 64, 66 and the respective illuminators 68, 70, 72 are fixed with respect to the upright 18. The first camera 62 and the second camera 64 are oriented with the respective optical axes L1, L2 horizontal and parallel to the outer face 48 of the conveyor belt 36, so as to view the ends of the caps C, which are orthogonal relative to the longitudinal axes of the caps C. More specifically, the first camera 62 and the second camera 64 are arranged to inspect the open front side and the closed dorsal side of each cap C. The third camera 66 is oriented with its optical axis L3 transverse relative to the optical axes L1 and L2 of the cameras 62, 64, so as to view the sides of the cap C.

With reference to FIG. 5, the walls 54 of the guide channel 52 are transparent alongside the fields of vision of the cameras 62, 64. Preferably, the wall 54 adjacent to the illuminators 68, 70 is formed of a generic transparent material while the wall 54 adjacent to the cameras 62, 64 has a section 76 of anti-reflective glass alongside the cameras 62, 64.

With reference to FIGS. 5 and 6, the guide channel 52 is straight and parallel to the conveyor belt 36 at the first and second cameras 62, 64. With reference to FIG. 6, alongside the third camera 66, the guide channel 52 has a portion 78 inclined with respect to the longitudinal axis of the conveyor belt 36. The inclined portion 78 of the guide channel 52 moves the caps C along a transverse direction relative to the longitudinal axis of the conveyor belt 36. As is shown in FIG. 6, the displacement in the transverse direction of the caps C serves to move the safety ring 80 of the caps C laterally to the outside relative to the side edge of the conveyor belt 36, so as to allow the illumination and viewing of the safety ring 80 of the caps C without obstructions. In this way, it is possible to inspect the safety ring 80 of the caps C by means of the third camera 66. Preferably, downstream of the inclined portion 78, the guide channel 52 has a straight portion 82 and a second inclined portion 84 with opposite inclination to the first inclined portion 78. At the portions 78, 82, 84, the projections 46 are misaligned with respect to the central longitudinal axis of the guide channel 52. One of the walls 54 of the channel 52 could have channels or openings to prevent interference with the projections 46.

The vision system of the caps according to the present invention allows inspection of the dorsal side, the inner thread and the safety ring of the caps C. In this way, it is possible to detect defects of ovalization, thread defects, defects of the safety ring, defects in the marking on the dorsal side, etc. The fact that the caps C are resting on the projections 46 on their side wall and with the front sides and the dorsal sides in visually inspectable positions allows an increase in the inspectable areas with respect to the vision systems of known type.

Of course, without prejudice to the principle of the invention, the details of construction and the embodiments may be widely varied with respect to what is described and illustrated without departing from the scope of the invention as defined by the following claims.

The invention claimed is:

1. An elevator for caps, comprising:

a closed-loop conveyor comprising:

an ascending branch;

a belt comprising:

an outer face extending in a longitudinal direction;

a plurality of projections protruding in a direction orthogonal to the outer face, wherein the projections are spaced apart by a constant pitch in the longitudinal direction; and wherein a seat is defined between each pair of adjacent projections, each seat being configured to receive a single cap;

a vertical stationary guide channel comprising two parallel walls orthogonal to the outer face of the belt provided with transparent sections, wherein in the ascending branch of the closed-loop conveyor the projections extend at least partially between the parallel walls;

at least one camera arranged to visually inspect the caps in the stationary guide channel while the caps move along the ascending branch of the conveyor; and an ejection device which ejects noncompliant caps from the elevator according to information provided by the at least one camera.

2. The elevator according to claim 1, the at least one camera further comprising:

a first and a second camera having respective optical axes horizontally and parallelly oriented to the outer face of the conveyor belt; and at least one third camera having an optical axis transverse relative to the optical axes of the first and second cameras.

3. The elevator according to claim 2, wherein said guide channel comprises a portion with a longitudinal axis tilted with respect to the longitudinal axis of the conveyor belt, arranged so as to move the caps in a direction transverse to the longitudinal axis of the conveyor belt alongside the third camera.

* * * * *